United States Patent [19]

Tominaga

[11] Patent Number: 4,608,000

[45] Date of Patent: Aug. 26, 1986

[54] AIR PUMP

[75] Inventor: Kazutoshi Tominaga, Higashi Osakashi, Japan

[73] Assignee: Kabushiki Kaisha Tominaga Jyushikogyosho, Higashi Osakashi, Japan

[21] Appl. No.: 679,309

[22] Filed: Dec. 7, 1984

[30] Foreign Application Priority Data

Dec. 29, 1983 [JP] Japan ..... 58-248321

[51] Int. Cl.[4] ..... F04B 17/04

[52] U.S. Cl. ..... 417/413; 310/30

[58] Field of Search ..... 417/413, 416, 417, 418, 417/415; 310/30

[56] References Cited

U.S. PATENT DOCUMENTS 4,259,653 3/1981 McGonigal ..... 310/30

FOREIGN PATENT DOCUMENTS 47-26404 8/1972 Japan .
47-26002 9/1972 Japan .
48-36247 2/1973 Japan .
53-140906 4/1978 Japan .
77581 6/1981 Japan ..... 417/413
2095766 10/1982 United Kingdom ..... 417/413

*Primary Examiner*—Carlton R. Croyle
*Assistant Examiner*—Donald E. Stout
*Attorney, Agent, or Firm*—Collard, Roe & Galgano

[57] ABSTRACT

An air pump for use in combination with a household aquarium, the air pump comprising an electromagnet having an inner iron core, a coil arranged around the inner iron core, and a cylindrical outer iron core arranged around the coil; and a bellows unit having a permanent magnet whose magnetic pole is extended toward the inner iron core but spaced therefrom, and a diaphragm operated by the permanent magnet.

7 Claims, 8 Drawing Figures

AIR PUMP

BACKGROUND OF THE INVENTION

1. Field of the Invention

The present invention relates to an air pump, and more particularly, to an air pump for use in combination with a household aquarium in which fishes and aquatic plants are reared for fancy or ornamental purposes.

2. Description of the Prior Art

So far there have been many types of air pumps for such purposes, among which is one disclosed in Japanese Utility Model Publication No. 47(1972)-26002. This prior art pump is provided with a diaphragm fixed to a vibrator, which is integral with a permanent magnet. The permanet magnet is placed in a magnetic field. By switching on the a.c. power, the permanent magnet is excited, thereby causing the diaphragm to vibrate through the movement of the vibrator. In this case, the vibrator is fixed to the casing of the pump, thereby unavoidably causing the casing to vibrate. This is the cause of noises. In addition, a resisting force exerts on the movement of the vibrator at the joint thereof to the casing, which leads to the energy loss. Furthermore, it is difficult to arrange the components linearly, and especially because of using a U-shape iron core the whole size becomes large. For such uses pumps should be as small as possible.

To prevent the energy loss and the harsh noises, many proposals have been made. Japanese Utility Model Publication (unexamined) No. 53(1978)-140906 discloses one of the proposals. This prior art pump is designed to vibrate the diaphragm directly by means of a permanent magent so as to prevent the energy loss. To this end, the pump is provided with a driving shaft integral with a permanent magnet, the driving shaft being connected to a diaphragm. There are provided two electromagnets opposedly to the permanent magnet. It is true that this arrangement has solved the problems of noise and energy loss, but because of the provision of the two electromagnets, which are essential for balancing the driving shaft, the size of the pump becomes large.

Another solutions have been proposed by Japanese Utility Model Publication Nos. 48(1973)-36247 and 47(1972)-26404. The pumps disclosed in these two specifications are provided with diaphragms fixed to vibrators, which have permanent magnets located opposedly to the iron cores of electromagnets. These pumps also employ U-shape iron cores, which results in an increased size as a whole. In addition, the noise resulting from the vibration of the vibrator is very high.

OBJECTS AND SUMMARY OF THE INVENTION

The present invention is directed to solve the problems pointed out with respect to the prior art air pumps, and has for its object to provide an improved air pump of relatively small size, suitable for mass production.

Another object of the present invention is to provide an improved air pump capable of minimizing energy loss and noise.

Other objects and advantages of the present invention will become more apparent from the following description when taken in connection with the accompanying drawings which show, for the purposes of illustration only, one embodiment in accordance with the present invention.

According to the present invention, there is provided an air pump which comprises:

an electromagnet having an inner iron core, a coil arranged around the inner iron core, and a cylindrical outer iron core arranged around the coil; and a bellows unit having a permanent magnet whose magnetic pole is extended toward the inner iron core but spaced therefrom, and a diaphragm operated by the permanent magnet.

DETAILED DESCRIPTION OF THE INVENTION

Figure 1:
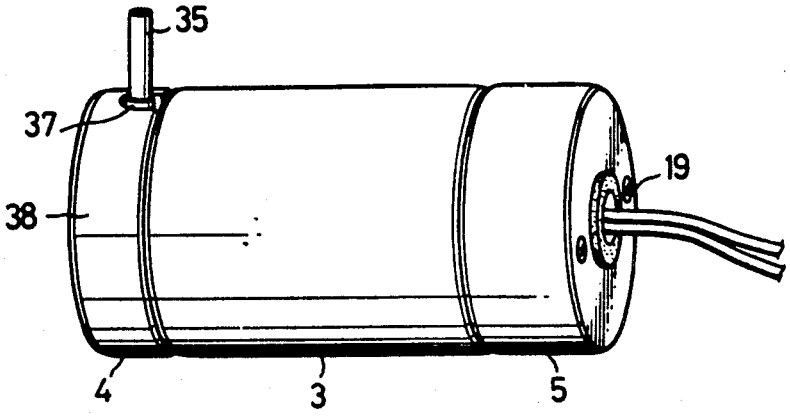
FIG. 1 is a perspective view showng an air pump embodying the present invention.

Referring to FIGS. 1 to 4, the air pump has an electromagnet 1, a bellows unit 2, a casing 3, and cap members 4, 5.

The electromagnet 1 is composed of a cylindrical inner iron core 6, a coil 9 wound around the inner iron core 6, a cylindrical outer iron core 10 arranged around the coil 9, wherein the reference numerals 11 and 12 designate ring-shaped end iron cores placed at opposite ends of the outer iron core 10. The end iron core 11 is provided with an aperture 13 through which a permanent magnet 17 is inserted. The other end iron core 12 and the inner iron core 6 are provided with an aperture 15 and a bore 14, respectively, through which a guide rod 18 of the permanent magnet 17 is inserted.

Figure 2:
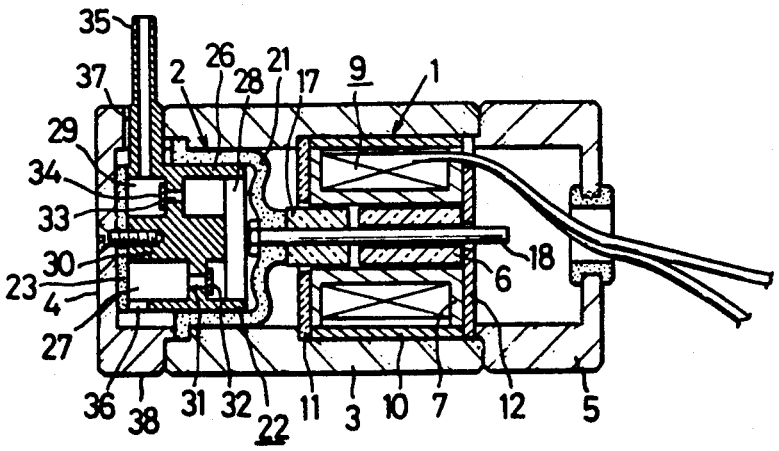
FIG. 2 is a cross-section through the air pump of FIG. 1.

As shown in FIG. 2, the right-hand end iron core 12 keeps contact with the inner iron core 6 and the outer iron core 10, whereas the left-hand iron core 11 keeps contact with the outer iron core 10, not with the inner iron core 6, thereby forming a magnetic way throughout the electromagnet 1. The iron cores 6, 10, 11 and 12 are made of soft steel, so that they can be easily fabricated. In order to minimize the eddy current loss under an a.c. operation, the iron cores are made of lamination of ferromagnetic material insulated from each other. In order to strengthen the magnetic nature, silicon steel can be used. The coil 9 is made by winding conductors 8 around a cylindrical bobbin 7 of plastics.

The electromagnet 1 is housed in the casing 3 of plastics with the cap member 5 fixed to the casing by means of screws 19. The conductors 8 of the coil 9 are led out through a recess 16 produced in the right-hand end iron core 12 and an aperture 20 produced in the cap member 5 so as to be connected to an a.c. power source (not shown).

The bellows unit 2 includes a diaphragm 21 of rubber, a pump unit 22 of plastics, and a packing 23 of rubber. The diaphragm 21 has the cylindrical permanent magnet 17 integrally fixed to the center thereof. The guide rod 18 is fixed to the permanent magnet 17 such that it is extended so as to be inserted through the bore 14 and the aperture 15. As best shown in FIG. 2, the pump unit 22 is inserted in the diaphragm 21, with the packing 23 being interposed against the cap member 4 at the opposite side. The packing 23 is fixed to the pump unit 22 by means of a screw 24. The bellows unit 2 is housed in the casing 3, and fixed thereto together with the cap member 4 by means of screws 25. The assembled state is shown in FIG. 2. It will be appreciated from it that the guide rod 18 is inserted through the outer iron core 10, the end iron core 11, the inner iron core 6, and the other end iron core 12, wherein the permanent magnet 17 is extended toward the inner iron core 6 at one end, and is extruded through the aperture 13 at the other end. The aperture 13 is made so as to allow the permanent magnet 17 to be spaced from the inner periphery 11*a* thereof.

As shown in FIG. 2, the pump unit 22 includes a chamber defined by an inside wall 26, which chamber is divided into three sections; a first section 27, a second section 28, and a third section 29. The reference numeral 30 designates a partition whereby the chamber is divided. The first and second sections 27 and 28 are communicated with each other through a valve hole 31, which is closed by a suction check valve 32 toward the second section 28, and the second and third sections 28 and 29 are communicated with each other through a valve hole 33, which is closed by a discharge check valve 34 toward the third section 29. An outlet 35 is provided integrally with the inside wall 26, through which the inside of the third section 29 is externally communicated. Likewise, an inlet port 36 is provided so as to allow the first section 27 to communicate to outside.

Figure 3:
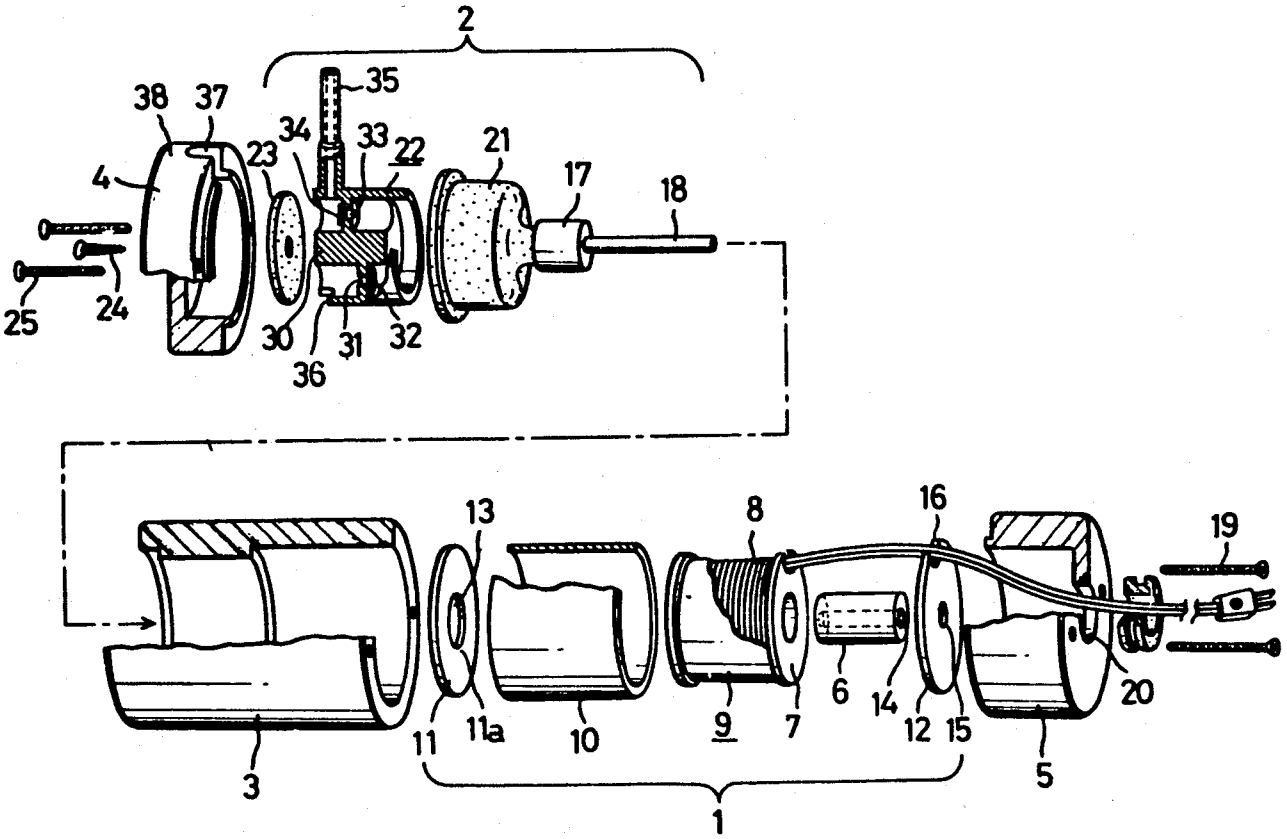
FIG. 3 is a perspective analytical view of the air pump of FIG. 1.

As shown in FIGS. 1 to 3, the cap member 4 is provided with a recess 37 in the periphery 38, through which the outlet 35 is extruded to outside. The recess 37 is made to be slightly larger than the diameter of the outlet 35, so as to allow outside air to enter the first section 27 therethrough. Outside air is also introduced therein through the inlet 36.

Figure 4A:
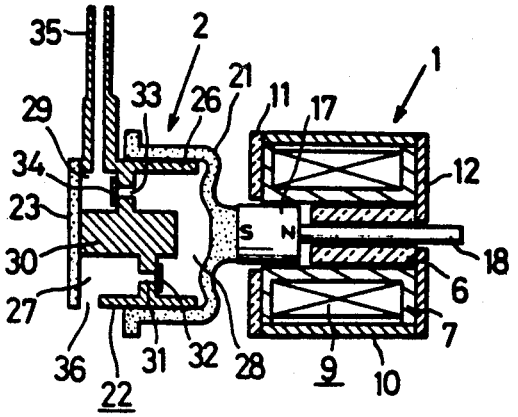
FIGS. 4(*a*), (*b*) and (*c*) are views exemplifying the steps of operation of the air pump of FIG. 1.
Figure 4B:
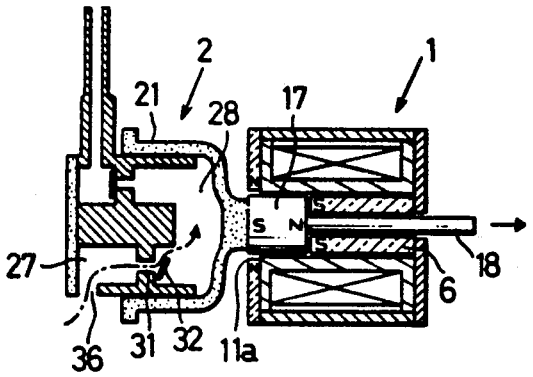
Figure 4C:
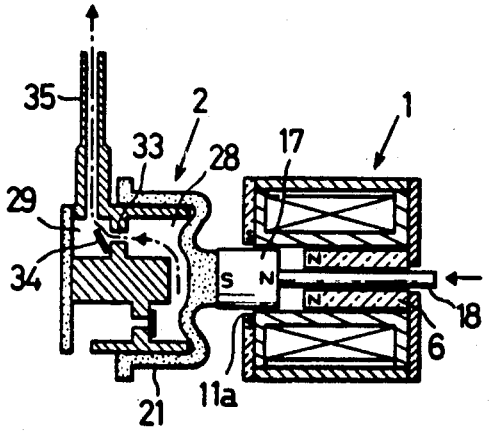

A typical example of operation will be now described:

On assumption that the permanent magent 17 has the polarity shown in FIG. 4(*a*), the electromagnet 1 is energized. An electric current flows through the coil 9, and the magnetic situation shown in FIG. 4(*b*) is produced, wherein one end of the inner iron core 6 is south-seeking while the inner periphery 11*a* of the left-hand end iron core 11 is north-seeking. As a result, the south-seeking side of the electromagnet 1 attracts the north-seeking side of the permanent magnet 17, and at the same time, the north-seeking side of the electromagnet 1 attracts the south-seeking side of the permanent magnet 17. At this situation the diaphragm 21 is expanded as shown in FIG. 4(*b*), thereby increasing the volume of the second section 28 in which the pressure accordingly lowers. As the inside pressure therein lowers, the suction check valve 32 is opened, thereby allowing air to enter the second section 28 through the inlet 36, the first section 27 and the valve hole 31. Subsequently, when the polarity of the a.c. power source (not shown) is reversed, a current flows in the reverse direction through the coil 9. As shown in FIG. 4(*c*), one end of the inner iron core 6 becomes north-seeking while the inner periphery 11*a* of the left-hand end becomes south-seeking. As a result, the north-seeking side of the electromagnet 1 repels the north-seeking side of the permanent magnet 17. Likewise, the south-seeking side of the electromagnet 1 repels the south-seeking side of the permanent magnet 17, thereby causing the diaphragm 21 to contract. As a result, the volume of the second section 28 decreases, thereby increasing the inside pressure to open the discharge check valve 34. In this way the air inside the second section 28 is let out through the valve hole 33, the third section 29 and the outlet 35.

The aforementioned procedure is repeated every time the polarity of the a.c. power source is reversed, thereby allowing air to be let out through the outlet 35. If the polarity of the permanent magnet is reversed, the same procedure will be repeated. The guide rod 18 is provided so as to enable the permanent magnet 17 to be spaced from the end iron core 11 and the inside surface of the bobbin 7, but because of the symmetrical action of magnetism, that is, attraction and repulsion, with respect to the axis of the permanent magnet 17, the guide rod 18 is not always essential. It is desirable for the permanent magnet 17 to have a weight sufficient to be resonant with the electromagnet 1, thereby securing an efficient vibration.

Figure 5:
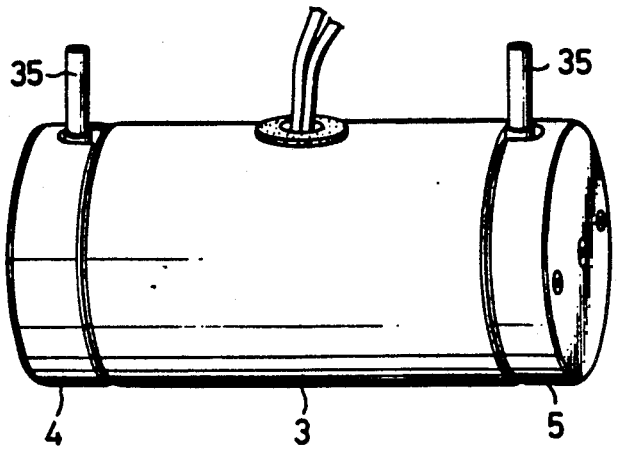
FIG. 5 is a perspective view showing a modified version of the embodiment.
Figure 6:
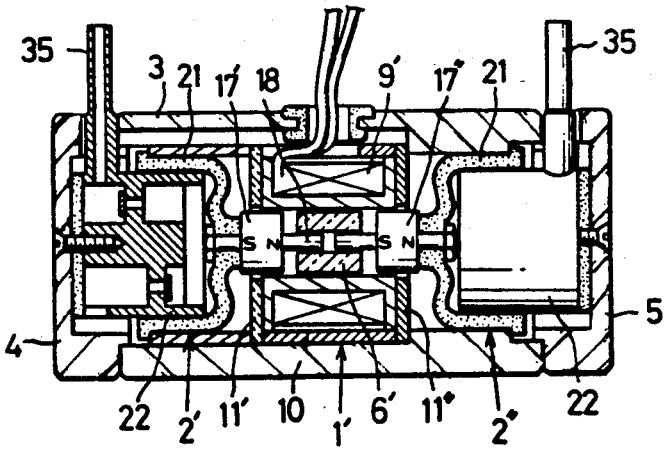
FIG. 6 is a cross-section through the air pump of FIG. 5.

Referring to FIGS. 5 and 6, a modified version will be described:

The modified air pump has two outlets 35, and two bellows units 2' and 2'' at opposite sides of the casing 3, wherein the bellows units are arranged axially of the coil 9', and symmetrically with respect to the central vertical line through the casing 3. The diaphragms 21 are operated by means of respective permanent magnets 17' and 17'', which are magnetized by a common inner iron core 6'. The permanent magnets 17' and 17'' have opposite polarities as shown in FIG. 6. When one permanent magnet 17' or 17'' is magnetized, the other is simultaneously magnetized in the opposite direction. The remaining structure and components are the same as those in the first example. Like reference numerals throughout the drawings designate like components and elements, the description of which is omitted for simplicty.

In the case of the second example, the two permanent magnets are vibrated on the common axis in opposite directions. As a result, the two vibrations are balanced thereby to reduce the noise occurring from vibrations. As evident from FIG. 6, the two bellows units are compactly housed in the casing 3, thereby simplifying the entire outer appearance as shown in FIG. 5.

In the illustrated embodiments the casing 3, the electromagnets, the permanent magnets, the bellows units and the cap members are all circular in cross-section. However, it is of course possible to arrange that they are polygonal in cross-section. Particularly a polygonal casing will be effective to prevent same from rolling on the aquarium.

According to the present invention, the following advantages are obtained:

(1) The permanent magnet is directly fixed to the diaphragm, without the use of a mediate means like a vibrator, thereby eliminating the cause of noise due to the vibration of the casing;

(2) Because of the direct transmission of vibration from the permanent magnet to the diaphragm, energy loss is avoided;

(3) Because the outer iron core is cylindrical, thereby minimizing the size of the electromagnet in comparison with when a conventional U-shaped iron core is employed. In addition, the radiating effect is increased because of the relatively large surface area thereof;

(4) The magnetic flux from the end of the outer iron core is centripetal to enter the end of the inner iron core, and when the polarities are reversed, it radially goes out of the end of the inner iron core, and enters the end of the outer iron core. Because the pole of the permanent magnet is placed near a point where magnetic flux is concentrated, the permanent magnet is efficiently vibrated; and (5) The pump unit, the diaphragm, and the permanent magnet are linearly arranged along the axis of the coil, thereby minimizing the size of the air pump. The minimized size of air pumps is nowadays in strong demand.

What is claimed is:

1. An airpump for a household aquarium, said airpump comprising:

(a) an electromagnet including a stationary inner iron core having an axial bore therethrough, a coil surrounding said stationary inner iron core, an outer iron core surrounding said coil and a pair of end iron cores disposed in contacting relationship with and at opposite ends of said outer iron core, said end iron cores having centrally located apertures therein axially aligned with the bore of said inner iron core and said inner iron core being in contact with a first one of said end iron cores;

(b) a bellows unit including a diaphragm attached at its center to a permanent magnet, said permanent magnet having extending axially therefrom a rod which passes through the openings in said end iron cores and which is movably received in the axial bore of said stationary inner iron core so that said permanent magnet is positioned adjacent to the second one of said end iron cores;

(c) a pump unit having a suction check valve and a discharge check valve, said pump unit being operatively connected to said diaphragm in an axial arrangement therewith, said air pump being activated as said permanent magnet is vibrated in an axial direction without contacting said electromagnet, said vibration being effected by alternating magnetic polar changes occurring in said inner iron core and said second one of said end iron cores; and (d) a casing for housing said electromagnet, said diaphragm and said pump unit.

2. An airpump as defined in claim 1, wherein the aperture in said second end iron core is adapted to receive said permanent magnet therethrough.

3. An air pump as defined in claim 1, wherein said iron cores are made of soft steel.

4. An air pump as defined in claim 1, wherein said iron cores are made of silicon steel.

5. An air pump as defined in claim 1, wherein said iron cores are made of laminations of ferromagnetic material insulated from each other.

6. An air pump as defined in claim 1, further comprising an additional bellows unit and an additional pump unit provided symmetrically to said first bellows and pump units, said additional units and said first units being arranged axially of said coil.

7. An air pump as defined in claim 6, further comprising two end iron cores having apertures adapted to receive the respective permanent magnets at the centers thereof, the end iron cores being placed in contact with the respective ends of said outer iron core.

* * * * *